US006791396B2

(12) United States Patent
Shor et al.

(10) Patent No.: US 6,791,396 B2
(45) Date of Patent: Sep. 14, 2004

(54) STACK ELEMENT CIRCUIT

(75) Inventors: Joseph S. Shor, Tel Mond (IL); Eduardo Maayan, Kfar Saba (IL)

(73) Assignee: Saifun Semiconductors Ltd., Netanya (IL)

( * ) Notice: Subject to any disclaimer, the term of this patent is extended or adjusted under 35 U.S.C. 154(b) by 0 days.

(21) Appl. No.: 09/983,511

(22) Filed: Oct. 24, 2001

(65) Prior Publication Data

US 2003/0076159 A1 Apr. 24, 2003

(51) Int. Cl.[7] ..... G05F 1/10; G05F 3/02
(52) U.S. Cl. ..... 327/543; 327/541
(58) Field of Search ..... 327/538, 540, 327/541, 543; 323/312, 313, 315, 316

(56) References Cited

U.S. PATENT DOCUMENTS

| | | | | |
|---|---|---|---|---|
| 4,173,766 | A | 11/1979 | Hayes | 357/23 |
| 4,380,057 | A | 4/1983 | Kotecha et al. | 365/185 |
| 4,630,085 | A | 12/1986 | Koyama | 357/23.5 |
| 4,742,491 | A | 5/1988 | Liang et al. | 365/218 |
| 4,847,808 | A | 7/1989 | Kobatake | 364/104 |
| 5,021,999 | A | 6/1991 | Kohda et al. | 365/168 |
| 5,075,245 | A | 12/1991 | Woo et al. | 437/43 |
| 5,168,334 | A | 12/1992 | Mitchell et al. | 257/324 |
| 5,204,835 | A | 4/1993 | Eitan | 365/185 |
| 5,214,303 | A | 5/1993 | Aoki | 257/390 |
| 5,241,497 | A | 8/1993 | Komarek | 365/104 |
| 5,276,646 | A | 1/1994 | Kim et al. | 365/189.09 |
| 5,280,420 | A | 1/1994 | Rapp | 363/60 |
| 5,295,108 | A | 3/1994 | Higa | 365/218 |
| 5,338,954 | A | 8/1994 | Shimoji | 257/326 |
| 5,349,221 | A | 9/1994 | Shimoji | 29/68 |
| 5,412,601 | A | 5/1995 | Sawada et al. | 365/185 |
| 5,418,743 | A | 5/1995 | Tomioka et al. | 365/189 |
| 5,424,978 | A | 6/1995 | Wada et al. | 365/184 |
| 5,434,825 | A | 7/1995 | Harari | 365/185 |
| 5,450,341 | A | 9/1995 | Sawada et al. | 365/185 |
| 5,450,354 | A | 9/1995 | Sawada et al. | 365/185 |
| 5,467,308 | A | 11/1995 | Chang et al. | 365/185.01 |
| 5,477,499 | A | 12/1995 | Van Buskirk et al. | 365/218 |
| 5,523,972 | A | 6/1996 | Rashid et al. | 365/185.22 |
| 5,553,030 | A | 9/1996 | Tedrow et al. | 365/226 |
| 5,559,687 | A | 9/1996 | Nicollini et al. | 363/60 |
| 5,568,085 | A | 10/1996 | Eitan et al. | 327/546 |
| 5,583,808 | A | 12/1996 | Brahmbhatt | 365/185.05 |
| 5,592,417 | A | 1/1997 | Mirabel | 365/187.07 |
| 5,606,523 | A | 2/1997 | Mirabel | 365/185.05 |
| 5,675,280 | A | * 10/1997 | Nomura et al. | 327/538 |

(List continued on next page.)

FOREIGN PATENT DOCUMENTS

GB 2157489 10/1985

OTHER PUBLICATIONS

U.S. patent application Ser. No. 08/902,890, Eitan, filed May 4, 2000.

(List continued on next page.)

*Primary Examiner*—Terry D. Cunningham
*Assistant Examiner*—Quan Tra
(74) *Attorney, Agent, or Firm*—Eitan, Pearl, Latzer & Cohen, Zedek, LLP

(57) ABSTRACT

A circuit including a reference element adapted to provide a reference current and having a control terminal and a first terminal, there being a voltage ($V_{ct}$) between the control terminal and the first terminal of the reference element, and a plurality of series-connected stack elements, each the stack element including a first terminal connected to a first voltage, and a control tern connected to a second terminal, the stack elements being adapted to receive at least one of the reference current and a multiple of the reference current, the stack elements and the reference element being matched such that a voltage between the control terminal and the first terminal of at least one of the stack elements is generally the same as $V_{ct}$.

18 Claims, 8 Drawing Sheets

U.S. PATENT DOCUMENTS

| | | | | | |
|---|---|---|---|---|---|
| 5,717,581 | A | | 2/1998 | Canclini | 363/60 |
| 5,726,946 | A | | 3/1998 | Yamagata et al. | 365/226 |
| 5,754,475 | A | | 5/1998 | Bill et al. | 365/185.25 |
| 5,768,192 | A | | 6/1998 | Eitan | 365/185.24 |
| 5,808,506 | A | * | 9/1998 | Tran | 323/315 |
| 5,812,456 | A | | 9/1998 | Hull et al. | 365/185.16 |
| 5,825,686 | A | | 10/1998 | Schmitt-Landsiedel et al. | 365/185.63 |
| 5,946,258 | A | | 8/1999 | Evertt et al. | 365/226 |
| 6,011,725 | A | | 1/2000 | Eitan | 365/185.33 |
| 6,064,251 | A | | 5/2000 | Park | 327/536 |
| 6,075,402 | A | | 6/2000 | Ghilardelli et al. | 327/536 |
| 6,094,095 | A | | 7/2000 | Murray et al. | 327/589 |
| 6,107,862 | A | | 8/2000 | Mukainakano et al. | 327/536 |
| 6,130,572 | A | | 10/2000 | Ghilardelli et al. | 327/536 |
| 6,163,048 | A | | 12/2000 | Hirose et al. | 257/315 |
| 6,198,342 | B1 | | 3/2001 | Kawai | 327/536 |
| 6,201,282 | B1 | | 3/2001 | Eitan | 257/390 |
| 6,433,624 | B1 | * | 8/2002 | Grossnickle et al. | 327/543 |

OTHER PUBLICATIONS

U.S. patent application Ser. No. 08/905,286, Eitan, filed Jul. 30, 1997.

U.S. patent application Ser. No. 09/082,280, Eitan, filed May 20, 1998.

U.S. patent application Ser. No. 09/413,480, Eitan, filed Oct. 6, 1999.

U.S. patent application Ser. No. 09/536,125. Eitan et al., filed Mar. 28, 2000.

Bude et al., "EEPROM/Flash Sub 3.0 V Drain–Source Bias Hot carrier Writing", IEDM 95, pp. 989–992.

Bude et al., "Secondary Electron Flash—a High Performance, Low Power Flash Technology for 0.35 $\mu$m and Below", IEDM 97, pp. 279–282.

Bude et al., "Modeling Nonequilibrium Hot Carrier Device Effects", Conference of Insulator Specialists of Europe, Sweden, Jun. 1997.

* cited by examiner

STACK ELEMENT CIRCUIT

FIELD OF THE INVENTION

The present invention relates generally to circuitry for memory cell arrays, such as circuitry that may be used for voltage regulators for erasable, programmable read only memories (EPROMs), electrically erasable, programmable read only memories (EEPROMs), and flash EEPROM memories, for example.

BACKGROUND OF THE INVENTION

Voltage regulators are circuits useful for providing accurate analog voltages for erasable, programmable read only memories (EPROMs) and other integrated circuits. A voltage regulator may typically comprise a reference voltage, a comparator, a driver and a resistor divider. An example of a prior art voltage regulator is shown in FIG. 1, and uses a so-called Miller architecture, well known in the art. A comparator GM1 is connected to the gate of a PMOS (p-channel metal oxide semiconductor) driver GM2. The comparator GM1 is supplied a supply voltage $V_{PP}$, and compares voltages IP and FB. The comparator GMI adjusts the gate voltage of the PMOS driver GM2 to equalize voltages IP and FB. The output voltage, OP, is thus a multiple of the input voltage, IP. The multiplication factor is determined by the resistor divider (RD) ratio between OP and FB.

A problem with this type of regulator is that a large current (typically >100 $\mu$A) is required across the resistor divider RD in order to establish the multiplication factor. It is possible to make this current arbitrarily small by increasing the resistance of the divider. However, this may have several undesirable effects. First, the drive capability of the regulator may be lowered. Second, increasing the resistance may require significant silicon area. Third, the speed of the feedback is a function of the current, and as such, lowering the current may substantially degrade the regulator's stability.

In EPROM applications, the $V_{PP}$ supply (FIG. 1) is usually a pumped voltage. Pumping from the chip supply ($V_{DD}$) to a higher voltage ($V_{PP}$) is a process that has a low efficiency. Any current consumption from $V_{PP}$ requires a significantly larger current consumption from $V_{DD}$, usually by a factor of 5–10. As such, it is critical to conserve current in regulators operating from a boosted source, such as those providing the wordline voltage in EPROMs. In the regulator of FIG. 1, the resistor divider drains current from the $V_{PP}$ supply, such that a current of 100 $\mu$A required across the resistor divider may mean a $V_{DD}$ current of 1 mA.

Accordingly, there is a need for a regulator that has a low current consumption from $V_{PP}$ or another supply, while providing a high drive capability.

SUMMARY OF THE INVENTION

The present invention seeks to provide a stack element circuit that may be used to provide an improved voltage regulator. The present invention may comprise stacked diode-connected transistors that receive a reference current or a multiple thereof from a reference element, which may be a reference transistor. Diode-connected transistors are transistors whose gate is connected to the drain. The diode-connected transistors and the reference element are preferably matched such that a gate-source voltage of the diode-connected transistors is generally the same as the gate-source voltage of the reference element.

There is thus provided in accordance with a preferred embodiment of the present invention a circuit including a reference element adapted to provide a reference current and having a control terminal and a first terminal, there being a voltage ($V_{ct}$) between the control terminal and the first terminal of the reference element, and a plurality of series-connected stack elements, each the stack element including a first terminal connected to a first voltage, and a control terminal connected to a second terminal, the stack elements being adapted to receive at least one of the reference current and a multiple of the reference current, the stack elements and the reference element being matched such that a voltage between the control terminal and the first terminal of at least one of the stack elements is generally the same as $V_{ct}$.

In accordance with a preferred embodiment of the present invention a voltage between the control terminal and the first terminal of each the stack element is generally the same as $V_{ct}$.

Further in accordance with a preferred embodiment of the present invention one of the first and second terminals comprises an input and the other of the first and second terminals comprises an output, and the output of a first stack element is connected to the input of a subsequent stack element.

Still further in accordance with a preferred embodiment of the present invention the reference element is at a voltage $V_{DD}$ and the stack elements are at voltage $V_{PP}$ wherein $V_{PP} \geqq V_{DD}$.

In accordance with a preferred embodiment of the present invention the stack elements include diode-connected transistors and the reference element includes a transistor, the diode-connected transistors and the reference element being matched such that a gate-source voltage of the diode-connected transistors is generally the same as $V_{ct}$.

Further in accordance with a preferred embodiment of the present invention the reference element is adapted to have a fixed $V_{ct}$ voltage.

Still further in accordance with a preferred embodiment of the present invention the circuit includes a voltage regulator having an input and an output, wherein the input is a control terminal of the reference element, and the output is an output of a top transistor of the stack, the top transistor being the first of the diode-connected transistors that receives the reference current.

In accordance with a preferred embodiment of the present invention the first terminal includes an input and the second terminal includes an output.

In accordance with a preferred embodiment of the present invention the stack elements and the reference element include NMOS (n-channel metal oxide semiconductor) transistors, and the first terminal includes an input including at least one of a source and bulk, the control terminal includes a gate, and the second terminal includes an output including a drain.

Further in accordance with a preferred embodiment of the present invention the reference element receives a reference voltage at the control terminal and the output generates the reference current.

Still further in accordance with a preferred embodiment of the present invention the stack elements and the reference element include NMOS transistors, wherein for each NMOS transistor, a resistor is connected between a source of the transistor and the first terminal, a bulk of the transistor is connected to at least one of the source and the first terminal, the control terminal includes a gate, the first terminal comprises an input of the stack element and the second terminal includes an output including a drain.

Additionally in accordance with a preferred embodiment of the present invention an input of the reference element is at ground (GND).

In accordance with a preferred embodiment of the present invention an output of the circuit is the output of the top stack element, the top stack element being the first of the stack elements that receives the reference current.

Further in accordance with a preferred embodiment of the present invention a bottom stack element, the bottom stack element being the last of the stack elements that receives the reference current, receives a second reference voltage at its input.

Still further in accordance with a preferred embodiment of the present invention the stack elements and the reference element include NMOS transistors, and the first terminal includes an input including at least one of a source and bulk, the control terminal includes a gate, and the second terminal includes an output including a drain, wherein the reference element receives a reference voltage at the control terminal and the output generates the reference current, wherein an input of the reference element is at ground (GND), wherein an output of the circuit is the output of the top stack element, the top stack element being the first of the stack elements that receives the reference current, and wherein a bottom stack element, the bottom stack element being the last of the stack elements that receives the reference current, receives a second reference voltage at its input.

In accordance with another preferred embodiment of the present invention the first terminal includes an output and the second terminal includes an inputs Further in accordance with a preferred embodiment of the present invention the stack elements and the reference element include PMOS (p-channel metal oxide semiconductor) transistors, and the first terminal includes an output including at least one of a source and bulk, the control terminal includes a gate, and the second terminal includes an input including a drain.

Still further in accordance with a preferred embodiment of the present invention the stack elements and the reference element include PMOS transistors, wherein for each PMOS transistor, a resistor is connected between a source of the transistor and the first terminal, a bulk of the transistor is connected to at least one of the source and the first terminal, the control terminal includes a gate, the first terminal comprises an input of the stack element and the second terminal includes an input including a drain.

Additionally in accordance with a preferred embodiment of the present invention the control terminal and the input of the reference element are at GND.

In accordance with a preferred embodiment of the present invention a reference voltage is placed at the output of the reference element.

Further in accordance with a preferred embodiment of the present invention the control terminal of a bottom stack element the bottom stack element being the last of the stack elements that receives the reference current, receives a second reference voltage and the input of the bottom stack element is at GND.

Still further in accordance with a preferred embodiment of the present invention the stack elements and the reference element include PMOS transistors, and the first terminal includes an output including at least one of a source and bulk, the control terminal includes a gate, and the second terminal includes an input including a drain, wherein the control terminal and the input of the reference element are at GND, wherein a reference voltage is placed at the output of the reference element, wherein an output of the circuit is the output of the top stack element, the top stack element being the first of the stack elements that receives the reference current, and wherein the control terminal of a bottom stack element, the bottom stack element being the last of the stack elements that receives the reference current, receives a second reference voltage and the input of the bottom stack element is at GND.

In accordance with a preferred embodiment of the present invention the reference element is connected to the stack elements via a current mirror.

Further in accordance with a preferred embodiment of the present invention the current mirror includes at least two matched transistors.

Still further in accordance with a preferred embodiment of the present invention a voltage across the stack elements includes the $V_{ct}$ multiplied by a number of the stack elements.

In accordance with a preferred embodiment of the present invention a first reference voltage ($V_{REF}$) is input to the reference element.

Further in accordance with a preferred embodiment of the present invention a second reference voltage is input to the stack elements.

Still further in accordance with a preferred embodiment of the present invention the second reference voltage includes the first reference voltage divided by a voltage divider.

Additionally in accordance with a preferred embodiment of the present invention the second reference voltage is equal to the first reference voltage divided by a predetermined factor Y, and wherein an output OP of the circuit is given by $OP=(S\times V_{REF})+(V_{REF}/Y)$ wherein S=the number of stack elements.

In accordance with a preferred embodiment of the present invention the voltage divider includes a resistor divider. The resistor divider may be buffered by a buffer. The output of the buffer may be input to the stack elements. The resistor divider may include a variable resistor divider or a digitally controlled resistor divider, for example.

Further in accordance with a preferred embodiment of the present invention there is a shunting path to at least one of the stack elements.

There is also provided in accordance with a preferred embodiment of the present invention a driver including fist and second PMOS transistors, first and second NMOS transistors, and first and second current sources, wherein a gate and a drain of the first PMOS transistor are connected to the first current source, and the first current source is grounded, and wherein a source of the first PMOS transistor is connected to a source of the first NMOS transistor, the first NMOS transistor having its gate and its drain connected to the second current source, the second current source being connected to a supply voltage, and wherein gates of the NMOS transistors are connected to each other, and gates of the FMOS transistors are connected to each other, and wherein a drain of the second NMOS transistor is connected to the supply voltage and a source of the second NMOS transistor is connected to an output of the driver, and wherein a drain of the second PMOS transistor is connected to GND, and a source of the second PMOS transistor is connected to the output of the driver.

In accordance with a preferred embodiment of the present invention the first and second current sources are derivable from a reference current.

Further in accordance with a preferred embodiment of the present invention the first and second current sources are generally equal.

Still further in accordance with a preferred embodiment of the present invention an input to the driver is connected to an output of a circuit including a reference element adapted to provide a reference current and having a control terminal and a first terminal, there being a voltage ($V_{ct}$) between the control terminal and the first terminal of the reference element, and a plurality of series-connected stack elements, each the stack element including a fist terminal connected to a first voltage, and a control terminal connected to a second terminal, the stack elements being adapted to receive at least one of the reference current and a multiple of the reference current, the stack elements and the reference element being matched such that a voltage between the control terminal and the first terminal of at least one of the stack elements is generally the same as $V_{ct}$, wherein a first reference voltage ($V_{REF}$) is input to the reference element, and wherein a second reference voltage is input to the stack elements.

There is also provided in accordance with a preferred embodiment of the present invention a circuit including a reference element adapted to receive a first reference voltage and provide a reference current, and a plurality of series-connected stack elements adapted to receive the reference current and provide a multiple of the fist reference voltage, wherein the multiple is a function of the number of the stack elements.

BRIEF DESCRIPTION OF THE DRAWINGS

The present invention will be understood and appreciated more fully from the following detailed description taken in conjunction with the appended draw in which.

DETAILED DESCRIPTION OF THE PRESENT INVENTION

Figure 1:
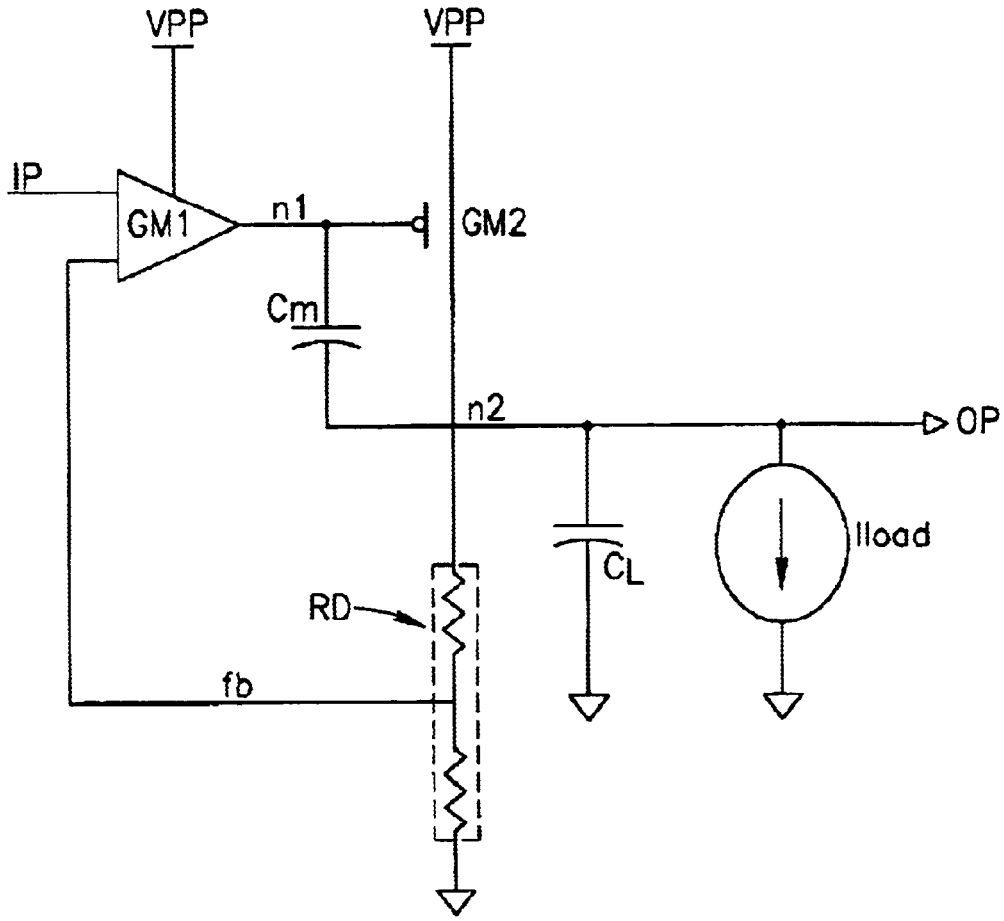
FIG.1 PRIOR ART
FIG. 1 is a schematic illustration of a prior art voltage regulator.
Figure 2:
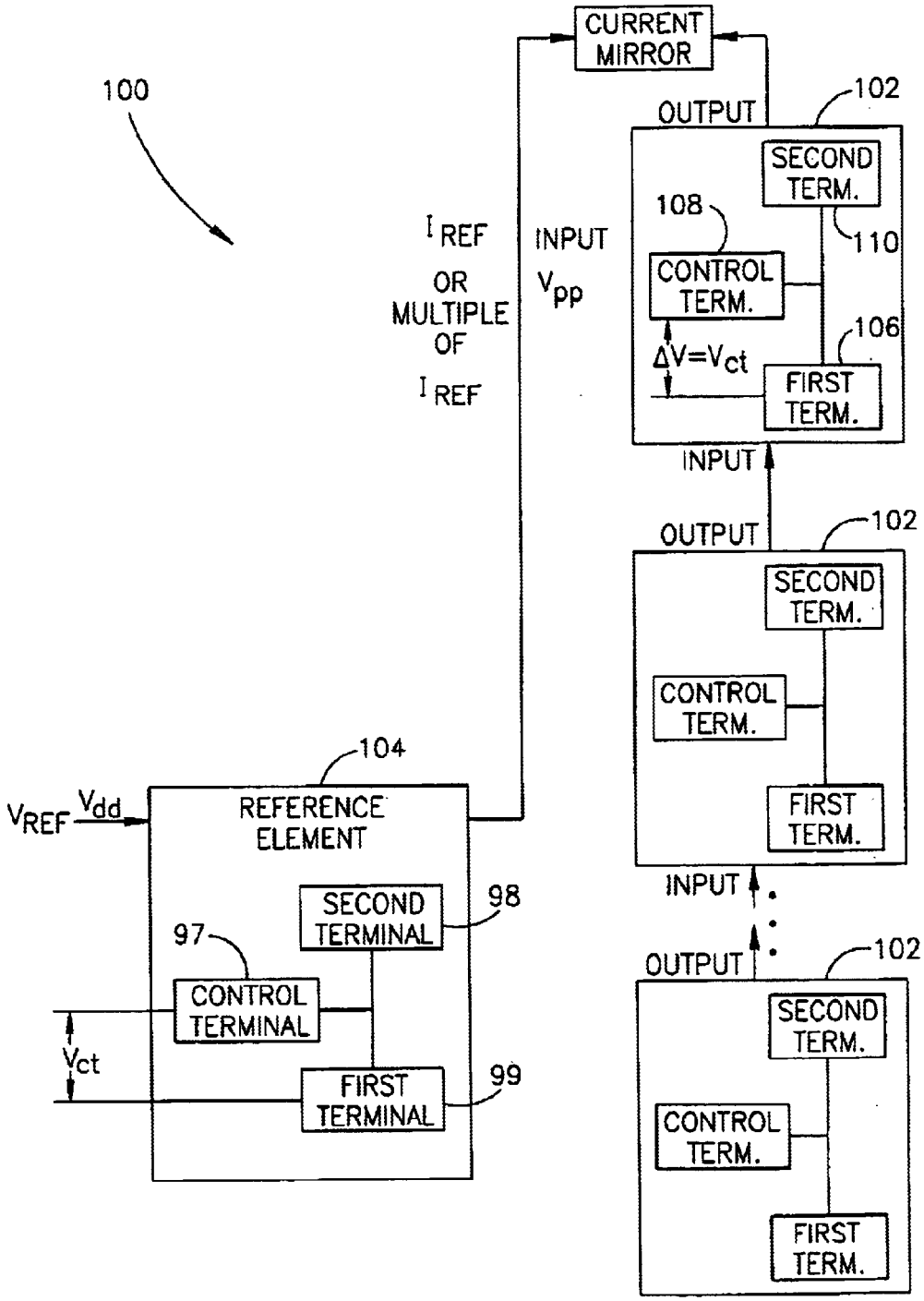
FIG. 2 is a schematic illustration of a general circuit comprising stack elements, which may be used as a voltage regulator circuit, constructed and operative in accordance with a preferred embodiment of the present invention.

Reference is now made to FIG. 2, which illustrates a circuit 100 comprising stack elements 102, which may be used as a voltage regulator circuit, con d and operative in accordance with a preferred embodiment of the present invention.

The circuit 100 may include a reference element 104 adapted to provide a reference current ($I_{ref}$) and having a control terminal 97, a first terminal 99 and a second terminal 98, there being a voltage ($V_{ct}$) between the control terminal 97 and the first terminal 99 of reference element 104. Reference element 104 may comprise an NMOS transistor, in which case control terminal 97 comprises a gate of the transistor, second terminal 98 comprises a drain of the transistor, first terminal 99 comprises a source of the transistor and $V_{ct}$ is the gate-source voltage ($V_{gs}$).

A plurality of series-connected stack elements 102 is preferably provided, wherein each stack element 102 comprises a first terminal 106, and a control terminal 108 connected to a second terminal 110. The stack elements 102 may receive the reference current $I_{ref}$ or a multiple thereof. The stack elements 102 and the reference element 104 are preferably matched. Two elements are considered "tcatched" if their lengths are substantially equal, and if their widths and current are either substantially equal or are the same multiple hereof The stack elements 102 and the reference element 104 are preferably matched such that the voltage between the control terminal 108 and the first terminal 106 of one or all of the stack elements 102 is generally the same as the $V_{ct}$ of the reference element 104. (It is noted again that if reference element 104 is a transistor, then $V_{ct}=V_{gs}$) The output of a first stack element 102 is connected to the input of a subsequent stack element 102. The reference element 104 may be at a voltage $V_{dd}$ and the stack elements may be at voltage $V_{pp}$ wherein $V_{pp} \geqq V_{dd}$.

The circuit 100 may be implemented in several ways in accordance with the present invention. More detailed examples of a circuit wherein the stack elements 102 and the reference element 104 comprise NMOS transistors are described hereinbelow with reference to FIGS. 3–6. A more detailed example of a circuit wherein the stack elements 102 and the reference element 104 comprise PMOS transistors is described hereinbelow with reference to FIG. 7. Two simplified and general examples of Circuits comprising NMOS transistors without and with a resistor are described hereinbelow with reference to FIGS. 8 and 9. Two simplified and general examples of circuits comprising PMOS transistors without and with a resistor are described hereinbelow with reference to FIGS. 10 and 11.

Figure 3:
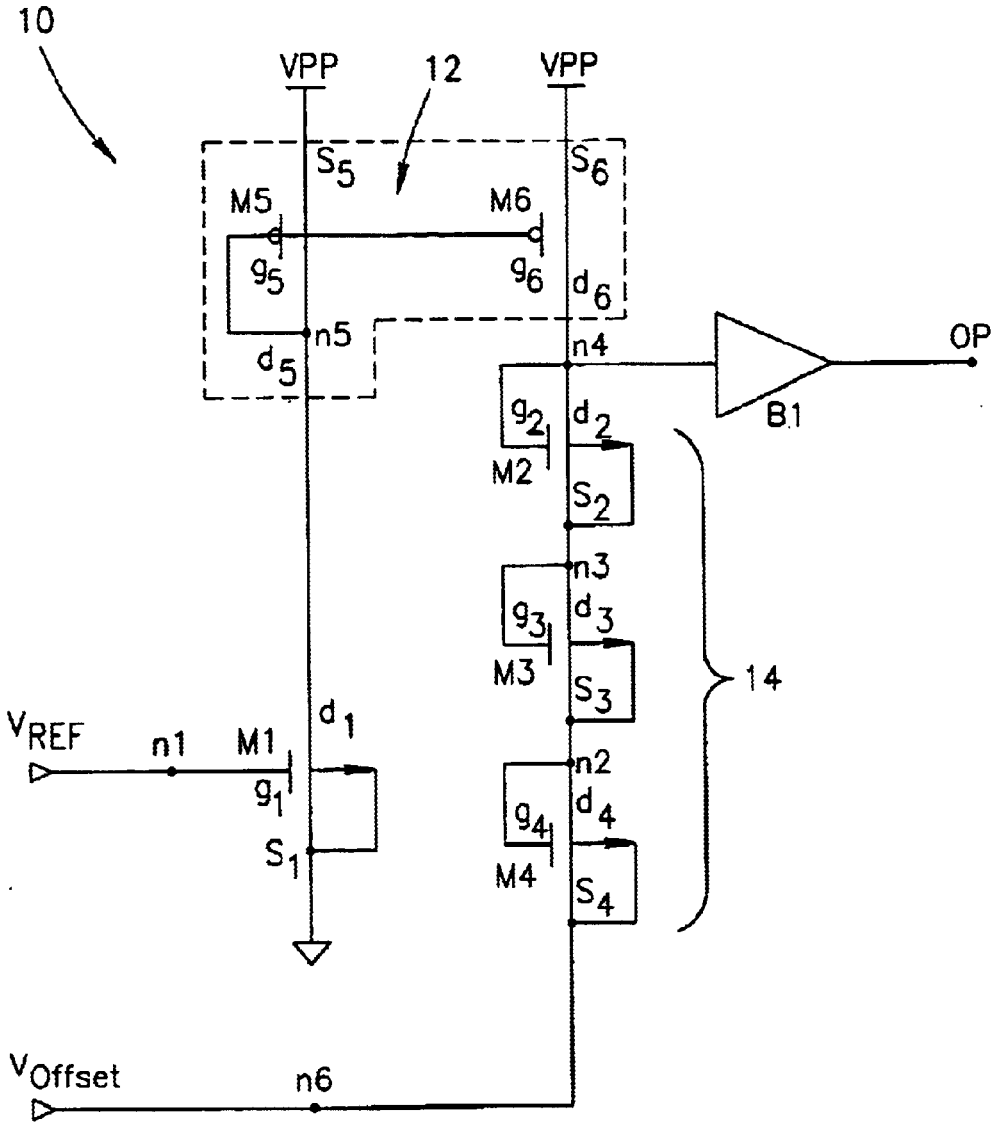
FIG. 3 is a schematic illustration of a voltage regulator constructed and operative in accordance with a preferred embodiment of the present invention, and using NMOS transistors.

Reference is now made to FIG. 3, which illustrates an implementation of the circuit 100 of FIG. 2 in a voltage regulator 10 constructed and operative in accordance with a preferred embodiment of the present invention.

A reference voltage $V_{REF}$ may be input via a circuit node $n_1$ into a gate $g_1$ of an NMOS reference element M1. A source $S_1$ and bulk of M1 are connected to GND. A drain $d_1$ of M1 is connected at a circuit node $n_5$ to a drain $d_5$ and a gate $g_5$ of a PMOS transistor M5, whose source $S_5$ and bulk are at $V_{PP}$. The gate $g_5$ of M5 is connected to a gate $g_6$ of a PMOS transistor M6, whose source $S_6$ and bulk are at $V_{PP}$. A drain $d_6$ of M6 is connected at a circuit node 114 to a gate $g_2$ and a drain $d_2$ of an NMOS transistor M2. A source $S_2$ and bulk of M2 are connected through a circuit node $n_3$ to a gate $g_3$ and a drain $d_3$ of an NMOS transistor M3. A source $S_3$ and bulk of M3 are connected at a circuit node $n_2$ to a gate $g_4$ and a drain $d_4$ of an NMOS transistor M4. A source $S_4$ and bulk of M4 may be connected at a circuit node $n_6$ to a second input (a second reference voltage) $V_{OFFSET}$. Circuit node $n_4$ is also connected to an input of a driver B1, whose output is an output of a regulator OP. Transistors M5 and M6 form a current mirror 12. A current mirror is defined as a circuit element or portion of a circuit that receives an input current and outputs the same input current or a multiple thereof.

In accordance wit a preferred embodiment of the present invention, the circuit of FIG. 3 is manufactured in a process that allows independent control of the NMOS bulk voltages. Examples of such processes are triple well processes, and silicon-on-insulator.

One operation of the circuit in accordance with an embodiment of the invention is as follows. The input reference voltage $V_{REF}$, which may typically be at a value of 1.3V, several 100 mV above the NMOS threshold voltage, is input to the gate $g_1$ of M1. M1 then acts as a current source at its drain $d_1$ providing a reference current $I_{ref}$, which may typically be 5–10 kA. This current may be subject to process variations, but these generally do not affect the output voltage.

The current $I_{ref}$ is fed into the current mirror 12 formed by transistors M5 and M6. If transistors M5 and M6 are matched, the current at the drain $d_6$ of M6 is $I_{ref}$, or in general, at least a multiple thereof. The NMOS transistors M1, M2, M3 and M4 are all preferably matched. Since transistors M2, M3 and M4 are all diode connected (i.e., gate connected to drain) and have generally the same current as M1, their gate-source voltage ($V_{gs}$) is generally the same as the gate-source voltage of M1.

The transistors M2, M3 and M4 form a "stack" 14, that is, a plurality of series-connected stack elements, wherein each of transistors M2, M3 and M4 is a stack element. The voltage across stack 14 is the gate-source voltage $V_{gs}$ multiplied by the number of transistors in the stack 14. In the illustrated embodiment, for example, since there are three transistors in the stack 14, the voltage between nodes $n_4$ and $n_6$ is three times $V_{REF}$. If a second reference voltage source, also referred to as an offset voltage $V_{OFFSET}$, is added at node $n_6$, the voltage at $n_4$ and OP is $3\times V_{REF}+V_{OFFSET}$. $V_{OFFSET}$ may be equal to $V_{REF}$ divided by a predetermined factor Y, as described hereinbelow. The value of OP may be increased/decreased by increasing/decreasing the number of transistors in the stack 14. In more general terms:

$$OP=(S\times V_{REF})+(V_{REF}/Y) \quad (1)$$

where S=the number of transistors in the stack 14 and Y is the divider ratio between $V_{REF}$ and $V_{OFFSET}$.

In principle, any output voltage may be achieved by varying the number of transistors in the stack 14 and the divider ratio between $V_{REF}$ and $V_{OFFSET}$. The driver B1 may be a class AB driver, which can drive the output strongly while using minimal quiescent current.

In accordance with embodiments described herein, transistor M2 is the "top" stack element, i.e., the first stack element to receive the reference current, and transistor M4 is the "bottom" stack element, i.e., the last stack element to receive the reference current.

Figure 4:
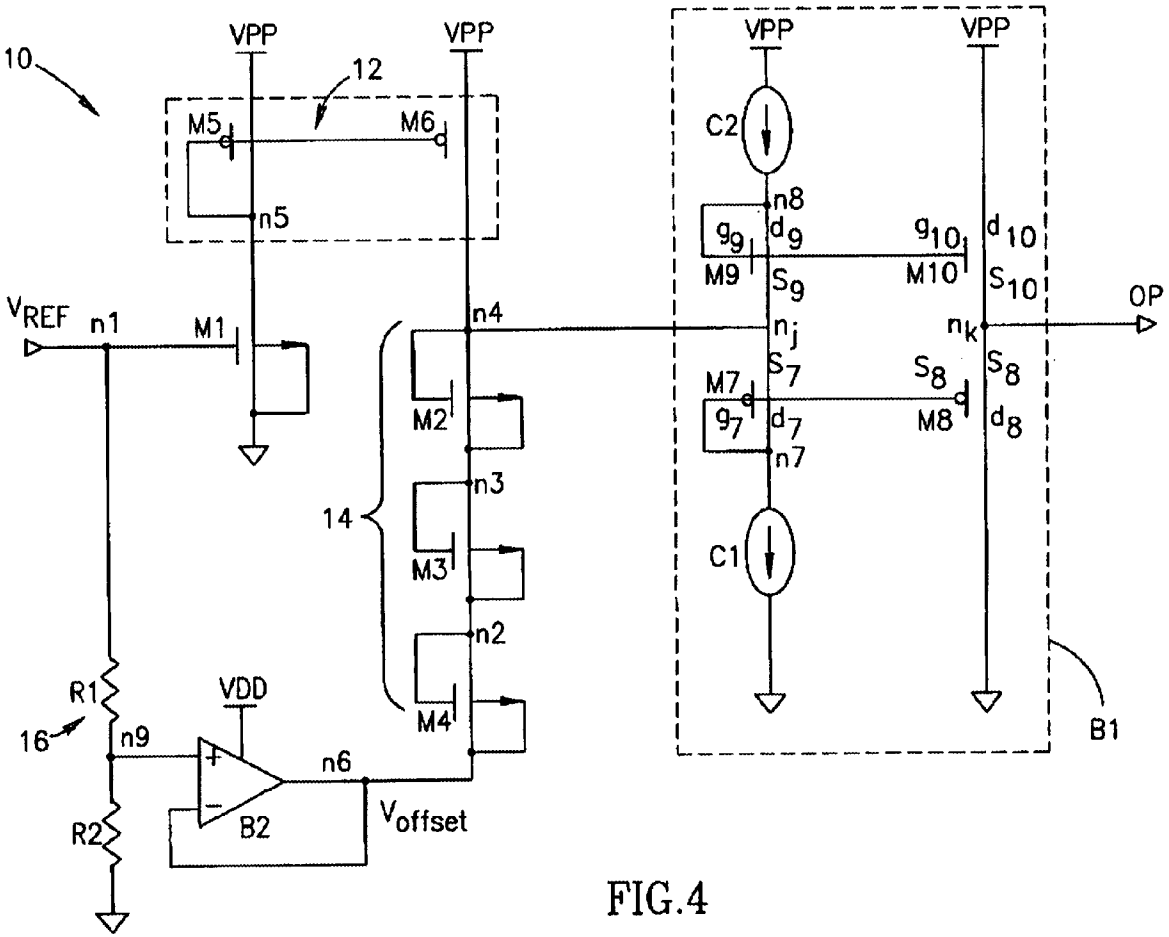
FIG. 4 is a schematic illustration of the voltage regulator of FIG. 3, illustrating diode-connected transistor circuitry, circuitry of a driver, and a circuit to generate a $V_{OFFSET}$ input used in the regulator of FIG. 3.

A more detailed version of the first embodiment is shown in FIG. 4. This schematic includes the circuit of FIG. 3, detailed circuitry of driver B1, as well as a circuit to generate the $V_{OFFSET}$ input.

In the embodiment of FIG. 4, the driver B1 is formed by PMOS transistors M7 and M8, NMOS transistors M9 and M10, and current sources C1 and C2. A gate $g_7$ and a drain $d_7$ of M7 are connected via a circuit node $n_7$ to current source C1. Current source C1 is grounded to GND. A source $S_7$ of M7 is connected at a circuit node $n_j$ to a source $S_9$ of transistor M9. The gate $g_9$ of M9 and its drain $d_9$ are connected to current source C2 via a circuit node no. The current source C2 is connected to $V_{PP}$. The gate $g_9$ of M9 is connected to a gate $g_{10}$ of transistor M10, whose drain $d_{10}$ is connected to $V_{PP}$ and whose source $S_{10}$ is connected to OP via a circuit node $n_k$. A gate $g_8$ of M8 is connected to the gate $g_7$ of transistor M7. A source $s_8$ of M8 is connected to node $n_k$, and a drain $d_8$ of M8 is connected to GND.

The circuit to generate the $V_{OFFSET}$ input preferably comprises a resistor divider 16. Resistor divider 16 may comprise, without limitation, a resistor R1 connected to $V_{REF}$ via circuit node $n_1$, and to a resistor B2 at circuit node 19, Resistor R2 is grounded to GND. A buffer B2 bas a positive input connected to node $n_9$, and a negative input connected to node $n_6$, which, as described hereinabove, is connected to source $S_4$ (not shown) and bulk of M4.

In the driver B1 of FIG. 4, transistors M7, M8, M9 and M10 and current sources C1 and C2 preferably have equal current and are matched. C1 and C2 may be derived from $I_{ref}$, or from another current reference. The current flowing in the stack 14 formed by transistors M2, M3, and M4 is generally unaffected by the presence of the current in current sources C1 and C2, because the two current sources compensate for each other. Thus, the voltage at n4 is still defined by equation 1.

Transistor M9 is diode connected, such that:

$$V(n_8)=V(n_4)+V_t+V_{dsat} \quad (2)$$

where $V_t$ is the threshold voltage of transistor M9 and $V_{dsat}$ is the degree to which the transistor M9 is turned on beyond the threshold, According to basic MOSFET physics, the drain current $I_d$ is described by;

$$I_d=k'W/L(V_{dsat})^2 \quad (3)$$

where k' is a process parameter, W and L are the width and length of the MOSFET and $$V_{dsat}=V_{gs}-V_t \quad (4)$$

with $V_{gs}$ being the gate-source voltage.

Similarly, transistor M7 is diode connected and $$V(n_7)=V(n_4)-V_t-V_{dsat} \quad (5)$$

Transistors M8 and M10 are preferably back-to-back source followers and are matched with M7 and M9, respectively. The symmetry between the four transistors M7, Mg, M9 and M10 causes:

a) OP to be generally at the same voltage as $n_4$ in steady state, b) the current flowing in the M7, M9 branch to be generally equal to that in the M8, M10 branch in steady state, and c) $V_{dsat}$(M8) to be generally equal to $V_{dsat}$(M7), and $V_{dsat}$(M9) to be generally equal to $V_{dsat}$(M10) in steady state.

If the voltage at OP differs from n4, then the $V_{dsat}$ of one of transistors M9 and M10 increases, whereas the $V_{dsat}$ of the other transistor (M8 or M10) decreases, in accordance with equation 4. This results in a large current (in accordance with equation 3), which restores the equality between $n_4$ and OP. Thus the drive capability at OP may be very high. However, the quiescent currents of the circuit of FIG. 4 may be very low (~20–30 $\mu$A).

The $V_{offset}$ input supplied at the source of M4 may be generated by resistor divider 16 from $V_{ref}$, which may be buffered by B2. It is noted that B2 may have $V_{DD}$ as the supply such that the current drains caused by the buffer and the resistor divider 16 are less costly than those in the prior art.

A further enhancement of the voltage regulator of FIG. 3 or FIG. 4 is now described with reference to FIG. 5, which includes digital control circuitry 18.

Digital control circuitry 18 to generate the $V_{OFFSET}$ input preferably comprises a resistor divider 20 that may comprise, without limitation, a resistor R1 connected to $V_{REF}$ via circuit node $n_1$, and to a resistor R2 at a circuit node $n_{12}$. Resistor R2 is connected to a resistor R3 at a circuit node $n_{11}$, and resistor R3 is connected to a resistor R4 via a circuit node $n_{10}$. Resistor R4 is grounded to GND. An NMOS transistor M14 has its source $S_{14}$ connected to node $n_{12}$, its gate $g_{14}$ connected to a digital input D1, and its drain $d_{14}$ connected to node $n_9$ via a circuit node $n_m$. An NMOS transistor M13 has its source $S_{13}$ connected to node $n_{11}$, its gate $g_{13}$ connected to a digital input D2, and its drain $d_{13}$ connected to node $n_9$ via node $n_m$. An NMOS transistor M12 has its source $S_{12}$ connected to node $n_{10}$, its gate $g_{12}$ connected to a digital input D3, and its drain $d_{12}$ connected to node $n_9$. As described hereinabove with reference to FIG. 4, buffer B2 has a positive input connected to node $n_9$, and a negative input connected to node $n_6$, which is connected to source $S_4$ and bulk of M4. An NMOS transistor M11 has its source $S_{11}$ connected to the gate $g_4$ of transistor M4, its gate $g_{11}$ connected to a digital input D4, and its drain $d_{11}$ connected to node $n_6$ via a circuit node $n_i$.

Figure 5:
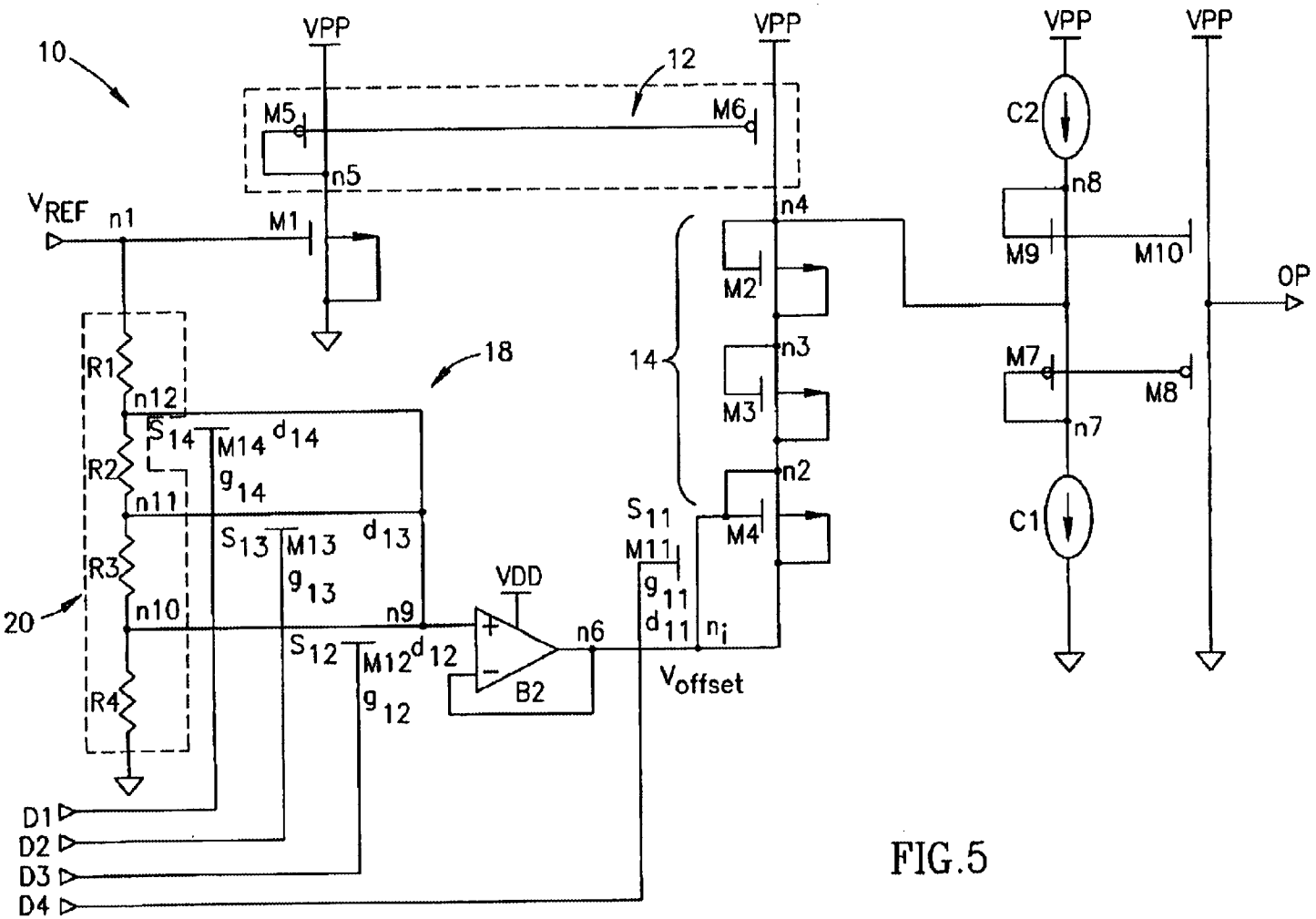
FIG. 5 is a schematic illustration of another version of the voltage regulator of FIG. 3, constructed and operative in accordance with another preferred embodiment of the present invention, and including digital control of the $V_{OFFSET}$ input and the number of stack elements in the circuit.

In the embodiment of FIG. 5, digital inputs D1, D2, and D3 turn on/off transistors M12, M13, and M14, thus determining which voltage along the resistor divider 20 is input to buffer B2. Id this manner, the $V_{OFFSET}$ may be digitally controlled to be an arbitrary value between VRBF and GND, determined by the amount of digital inputs and transistors used. When the digital input D4 is enabled, transistor M11 shunts the $V_{gs}$ of transistor M4. Thus, the number of transistors in the diode stack 14 may also be determined digitally, The embodiment of FIG. 5 allows digital control of the S and Y values in equation 1 for a given regulator. In an EPROM device, this may be a very useful feature to allow different trim levels for the wordline voltage.

Figure 6:
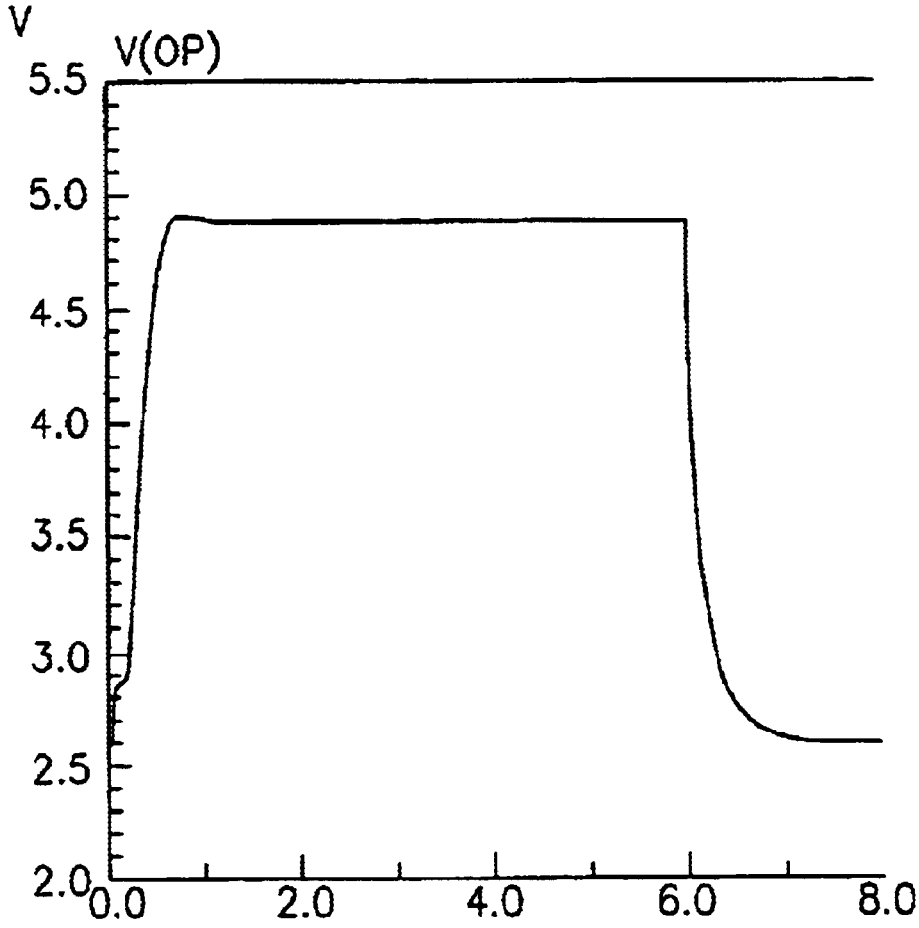
FIG. 6 is a graphical illustration of a rise and fall of an output voltage of the voltage regulator of FIG. 5, in accordance with a preferred embodiment of the present invention.

Reference is now made to FIG. 6, which illustrates a SPICE simulation of the rise and fall of OP for the circuit in FIG. 5. In the example of FIG. 6, OP is driven from $V_{DD}$ (2.6V) to 4.9V and back to $V_{DD}$. The values of $V_{REF}$ and $V_{OFFSET}$ are 1.3V and 1V respectively. The output capacitance is 50 pF. The regulator raises V(OP) to its final value in <1 $\mu$s. This requires currents in the mA range. The quiescent current is 30 $\mu$A, typical of class AB operation. It is emphasized-that these are only exemplary values, and the present invention is not limited to these values.

The circuits shown in FIGS. 3–5 all use NMOS transistors in the $V_{gs}$ stack and to generate $I_{ref}$. However, in order to have good $V_{gs}$ matching between these transistors, it may be preferable to have independent control of the bulk voltage. In most CMOS process, all of the NMOS bulks may be permanently grounded, such that the $V_{gs}$ voltages in the stack may differ as a result of the bulk effect. For these processes, it is possible to implement the regulator with another embodiment of the present invention, which uses PMOS transistors for the reference current and the $V_{gs}$ stack, as is now described with reference to FIG. 7.

A gate $g_1$, and a drain $d_1$ of a PMOS reference element M1' are connected to GND. A source $S_{1'}$ of M1' is connected at a circuit node $n_{13}$ to the positive input of a comparator B1' and to its bulk. A drain $d_{15}$ of a PMOS transistor M15 is connected to node $n_{13}$. A gate $g_{15}$ of M15 is connected to output of comparator B1' at a node $n_{14}$, and to a gate $g_{16}$ of a PMOS transistor M16. A source $S_{15}$ of M15 is connected to $V_{DD}$. A source $S_{16}$ of M16 is connected to $V_{DD}$. A gate $g_{17}$ and a drain $d_{17}$ of an NMOS transistor M17 are connected to a drain $d_{16}$ of Resistor M16 at a node $n_{15}$. A source $S_{17}$ of M17 is grounded to GND. The gate $g_{17}$ of M17 is connected to a gate $g_{18}$ of an NMOS transistor M18, whose source $S_{18}$ is grounded to GND. A drain $d_{18}$ of M18 is connected at node $n_5$ to the drain $d_5$ of PMOS transistor M5. Some of the transistors form current mirrors. For example, transistors M5 and M6 form a current mirror, transistors M15 and M6 form a current mirror, wherein transistor M15 is also used to generate the voltage at node $n_{13}$; transistors M17 and M18 form a current mirror; and the combination of transistors M5, M6, M15, M16, M17 and M18 forms a current mirror that receives an input current from the reference element and outputs the same input current or a multiple thereof to the stack elements.

The drain $d_6$ of M6 is connected at node $n_4$ to a source and bulk $S_{2'}$ of a PMOS transistor M2'. A gate $g_{2'}$ and a drain $d_{2'}$ of transistor M2' are connected through node $n_3$ to a source and bulk $S_3$, of a PMOS transistor M3'. A gate $g_{3'}$ and a drain $d_{3'}$ of transistor M3' are connected through node $n_2$ to a source and bulk $S_{4'}$ of a PMOS transistor M4'. A gate $g_{4'}$ of transistor M4' is connected through node $n_6$ to node $n_9$, to which are connected resistors R1 and R2 of resistor divider 16. As described hereinabove with reference to FIG. 4, resistor divider 16 may comprise without limitation resistor R1 connected to $V_{REF}$ via node $n_1$, and to resistor R2 at node $n_9$. Resistor R2 is grounded to GND. Comparator B1' has a positive input connected to node $n_{13}$, and a negative input connected to node $n_1$. Comparator B1' receives $V_{DD}$. Driver B1 is connected to node $n_4$ as described hereinabove with reference to FIG. 4.

Figure 7:
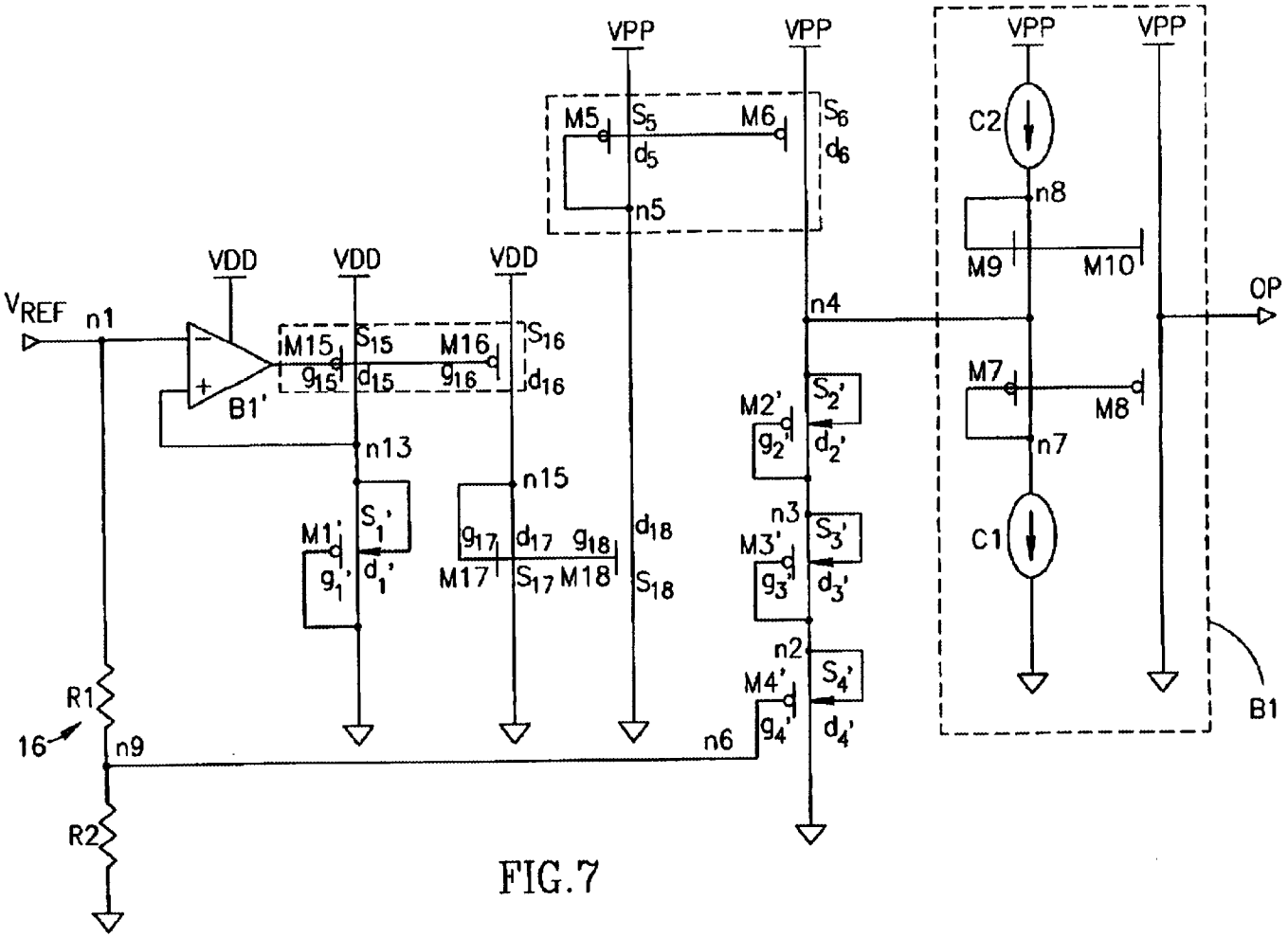
FIG. 7 is a schematic illustration of yet another version of the voltage regulator of FIG. 3, constructed and operative in accordance with yet another preferred embodiment of the present invention, and including PMOS transistors.

The reference current, $I_{ref}$ is generated across PMOS transistor M1' in the embodiment of FIG. 7. Transistor M1' is connected as a diode (gate to drain), and its source is driven by M15 at node $n_{13}$. The source voltage of M1' is fed back to the positive input of comparator B1', which has its negative input at $V_{REF}$. The operational amplifier formed by B1' and M15 equalizes the positive and negative inputs, such that $V(n_{13})=V_{REF}$. The current in M1' ($I_{ref}$) is mirrored through transistors M16, M17, MI8, M5 and M6 to the $V_{gs}$ diode stack 14' formed by M2', M3' and M4'. The voltage between the gate of M4' and the source of M2' is $3\times V_{REF}$, since M1', M2', M3' and M4' are matched in current and dimension. In addition, the offset voltage may be driven to the gate of M4 by the resistor divider 16 from $V_{REF}$, such that the voltage at $n_4$ is defined by equation 1. The output buffer (i.e., driver) that is formed by current sources C1 and C2 and by transistors M7–M10 is generally identical to that shown in FIGS. 4 and 5. In principle, any output buffer (driver) may be used in the embodiment of FIG. 7, if and when necessary. The digital enhancements shown in FIG. 5 may also be implemented in the embodiment of FIG. 7. The circuit of FIG. 7 obeys equation (1).

Figure 8:
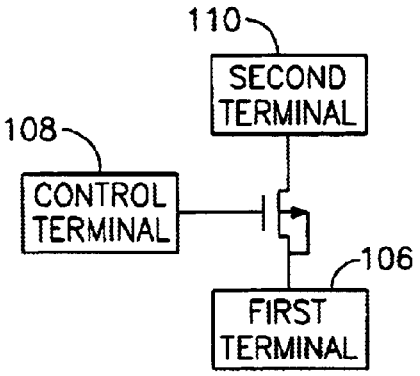
FIGS. 8 and 9 are schematic illustrations of stack elements of the general circuit of FIG. 2, which comprises NMOS transistors, in accordance with a preferred embodiment of the present invention, respectively without and with a resistor.

As mentioned hereinabove, the circuit 100 may be implemented without and with a resistor in accordance with the present invention. For example, as shown in FIG. 8, the stack elements 102 and the reference element 104 of circuit 100 may comprise NMOS transistors. In such an embodiment, the control terminal 108 comprises the gate of the NMOS transistor, the first terminal 106 comprises the input which is the source and bulk of the NMOS transistor, and the second terminal 110 comprises the output which is the drain of the NMOS transistor, as described hereinabove with reference to the embodiment shown in FIG. 3.

Figure 9:
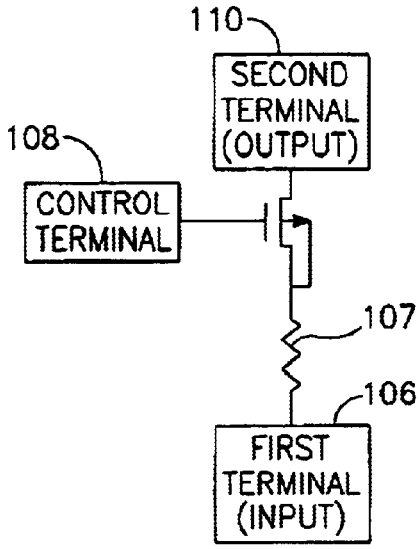

Referring to FIG. 9, a resistor 107 may be connected between the source of the NMOS transistor and the first terminal 106. The bulk may be connected either to the source or the first terminal 106. Resistor 107 is preferably connected this way in the stack elements 102 and the reference element 104.

Figure 10:
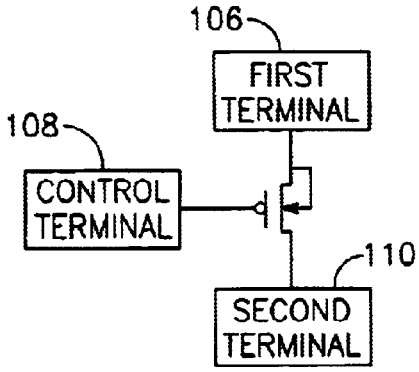
FIGS. 10 and 11 are schematic illustrations of stack elements of the general circuit of FIG. 2, which comprises PMOS transistors, in accordance with a preferred embodiment of the present invention, respectively without and with a resistor.

Reference is now made to FIG. 10, which illustrates another embodiment of the circuit 100, wherein the stack elements 102 and the reference element 104 comprise PNOS transistors. In such an embodiment, the fast terminal 106 comprises an output comprising at least one of the source and bulk of the PMOS transistor, the control terminal 108 comprises the gate of the PMOS transistor, and the second terminal 110 comprises the input comprising the drain of the PMOS transistor, as described hereinabove with reference to the embodiment of FIG. 7.

Figure 11:
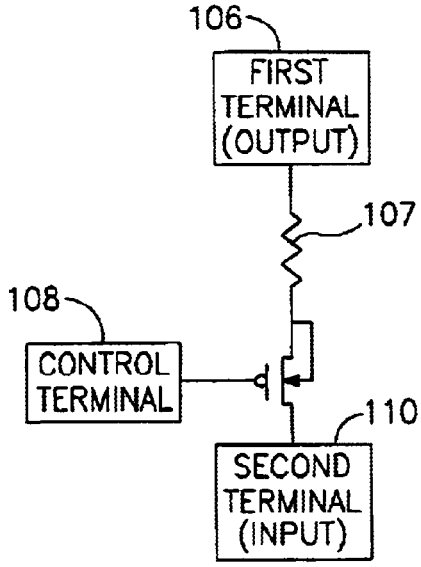

Referring to FIG. 11, a resistor 107 may be connected between the source of the PMOS transistor and the first terminal 106. The bulk may be connected either to the source or the first terminal 106. Resistor 107 is preferably connected this way in the stack elements 102 and the reference element 104.

Connecting resistor 107 between the source of the transistor and the first terminal 106, as in FIGS. 9 and 11, may achieve a more uniform temperature coefficient of current for the reference and stack elements. In other words, the reference and stack currents may be more uniform over a wide range of temperature.

It will be appreciated by persons skilled in the art that the present invention is not limited by what has been particularly shown and described herein above. Rather the scope of the invention is defined by the claims that follow:

What is claimed is:

1. A circuit comprising:

a reference element adapted to provide either a reference current or a multiple of said reference current and having a control terminal and a first terminal, there being a voltage ($V_{ct}$) between said control terminal and said first terminal of said reference element; and a plurality of series-connected stack elements, each said stack element comprising a first terminal and a control terminal connected to a second terminal, wherein one of said first and second terminals comprises an input and the other of said first and second terminals comprises an output, and the output of a first stack element is connected to the input of a subsequent stack element, said stack elements being adapted to receive from said reference element either said reference current or a multiple of said reference current, said stack elements and said reference element being matched such that a voltage between said control terminal and said first terminal of at least one of said stack elements is generally the same as $V_{ct}$, wherein a voltage across one or more of said stack elements being a function of a parameter independent of any parameters associated with said reference element, and wherein said stack elements and said reference element comprise NMOS transistors, wherein for each NMOS transistor, a resistor is connected between a source of said transistor and said first terminal, a bulk of said transistor is connected to at least one of the source and said first terminal, said control terminal comprises a gate, said first terminal comprises an input of said stack element and said second terminal comprises an output comprising a drain.

2. A circuit comprising:

a reference element adapted to provide either a reference current or a multiple of said reference current and having a control terminal and a first terminal, there being a voltage ($V_{ct}$) between said control terminal and said first terminal of said reference element; and a plurality of series-connected stack elements, each said stack element comprising a first terminal and a control terminal connected to a second terminal, wherein one of said first and second terminals comprises an input and the other of said first and second terminals comprises an output, and the output of a first stack element is connected to the input of a subsequent stack element, said stack elements being adapted to receive from said reference element either said reference current or a multiple of said reference current, said stack elements and said reference element being matched such that a voltage between said control terminal and said first terminal of at least one of said stack elements is generally the same as $V_{ct}$, wherein a voltage across one or more of said stack elements being a function of a parameter independent of any parameters associated with said reference element, and wherein said stack elements and said reference element comprise NMOS (p-channel metal oxide semiconductor) transistors, and said first terminal comprises an output comprising at least one of a source and bulk, said control terminal comprises a gate, and said second terminal comprises an input comprising a drain.

3. A circuit comprising:

a reference element adapted to provide either a reference current or a multiple of said reference current and having a control terminal and a first terminal, there being a voltage ($V_{ct}$) between said control terminal and said first terminal of said reference element; and a plurality of series-connected stack elements, each said stack element comprising a first terminal and a control terminal connected to a second terminal, wherein one of said first and second terminals comprises an input and the other of said first and second terminals comprises an output, and the output of a first stack element is connected to the input of a subsequent stack element, said stack elements being adapted to receive from said reference element either said reference current or a multiple of said reference current, said stack elements and said reference element being matched such that a voltage between said control terminal and said first terminal of at least one of said stack elements is generally the same as $V_{ct}$, wherein a voltage across one or more of said stack elements being a function of a parameter independent of any parameters associated with said reference element, and wherein said stack elements and said reference element comprise PMOS transistors, wherein for each PMOS transistor, a resistor is connected between a source of said transistor and said first terminal, a bulk of said transistor is connected to at least one of the source and said first terminal, said control terminal comprises a gate, said first terminal comprises an output of said stack element and said second terminal comprises an input comprising a drain.

4. The circuit according to claim 2 wherein said control terminal and the input of said reference element are at GND.

5. The circuit according to claim 4 wherein a reference voltage is placed at the output of said reference element.

6. The circuit according to claim 2 wherein the control terminal of a bottom stack element, said bottom stack element being the last of said stack elements that receives said reference current, receives a second reference voltage and the input of said bottom stack element is at GND.

7. A circuit comprising:

a reference element adapted to provide either a reference current or a multiple of said reference current and having a control terminal and a first terminal, there being a voltage ($V_{ct}$) between said control terminal and said first terminal of said reference element; and a plurality of series-connected stack elements, each said stack element comprising a first terminal and a control terminal connected to a second terminal, wherein one of said first and second terminals comprises an input and the other of said first and second terminals comprises an output, and the output of a first stack element is connected to the input of a subsequent stack element, said stack elements being adapted to receive from said reference element either said reference current or a multiple of said reference current, said stack elements and said reference element being matched such that a voltage between said control terminal and said first terminal of at least one of said stack elements is generally the same as $V_{ct}$, wherein a voltage across one or more of said stack elements being a function of a parameter independent of any parameters associated with said reference element;

wherein said stack elements and said reference element comprise PMOS transistors, and said first terminal comprises an output comprising at least one of a source and bulk, said control terminal comprises a gate, and said second terminal comprises an input comprising a drain;

wherein said control terminal and the input of said reference element are at GND;

wherein a reference voltage is placed at said output of said reference element;

wherein an output of said circuit is the output of the top stack element, said top stack element being the first of said stack elements that receives said reference current; and wherein the control terminal of a bottom stack element, said bottom stack element being the last of said stack elements that receives said reference current, receives a second reference voltage and the input of said bottom stack element is at GNT).

8. The circuit according to claim 1, wherein a first reference voltage (VREF) is input to said reference element, and wherein a second reference voltage is input to said stack elements.

9. The circuit according to claim 8 wherein said second reference voltage comprises said first reference voltage divided by a voltage divider.

10. The circuit according to claim 9 wherein said voltage divider comprises a resistor divider.

11. The circuit according to claim 10 wherein said resistor divider is buffered by a buffer.

12. The circuit according to claim 11 wherein an output of said buffer is input to said stack elements.

13. The circuit according to claim 10 wherein said resistor divider comprises a variable resistor divider.

14. The circuit according to claim 10 wherein said resistor divider comprises a digitally controlled resistor divider.

15. The circuit according to claim 10 wherein said resistor divider is buffered by a buffer, and said resistor divider comprises a digitally controlled resistor divider, wherein an output of said resistor divider is input to said buffer.

16. The circuit according to claim 14 and comprising a shunting path to at least one of said stack elements.

17. A circuit comprising:

a reference element adapted to receive a first reference voltage and provide either a reference current or multiple of said reference current; and a plurality of series-connected stack elements adapted to receive said reference current and provide a multiple of said first reference voltage, wherein said multiple is a function of the number of said stack elements, wherein a voltage across one or more of said stack elements being a function of a parameter independent of any parameters associated with said reference element, and wherein a second reference voltage is input to said stack elements, said second reference voltage comprising said first reference voltage divided by a voltage divider.

18. The circuit according to claim 17 wherein said second reference voltage is equal to said first reference voltage divided by a predetermined factor Y, and wherein an output OP of said circuit is given by:

OP $(S \times V_{REF}) + (V_{REF}/Y)$ wherein S=the number of stack elements.

* * * * *